United States Patent [19]

Girty

[11] Patent Number: 4,537,337

[45] Date of Patent: Aug. 27, 1985

[54] BOOT REMOVAL APPARATUS

[76] Inventor: Vernon L. Girty, P.O. Box 1304, Forsyth, Mont. 59327

[21] Appl. No.: 642,882

[22] Filed: Aug. 21, 1984

[51] Int. Cl.[3] ..... A47J 51/02

[52] U.S. Cl. ..... 223/114; D2/378.2

[58] Field of Search ..... 223/113, 114, 115, 116, 223/117; D2/378.2

[56] References Cited

U.S. PATENT DOCUMENTS

D. 143,819 2/1946 Hauret ..... D2/378.2
D. 229,118 11/1973 Shechtman et al. ..... D2/378.2

FOREIGN PATENT DOCUMENTS 2651 of 1879 United Kingdom ..... 223/113
2031264 4/1980 United Kingdom ..... 223/113

*Primary Examiner*—Robert R. Mackey
*Attorney, Agent, or Firm*—Arthur L. Urban

[57] ABSTRACT

Boot removal apparatus includes a platform portion, an undercarriage portion and a boot gripping portion. The platform portion includes a substantially rectangular bed section with a length significantly longer than the width thereof. The undercarriage portion includes a transverse axle section extending under the bed section with free ends of the axle section extending beyond the side edges of the bed section and wheels mounted on the free ends of the axle section. A first U-shaped member is mounted under the bed section adjacent an end thereof so free ends thereof are in contact with an underside of the bed section and an arcuate section thereof extends beyond the bed section. The free ends of the first member are aligned longitudinally of the bed section. The first member has a thickness significantly less than a radius of the wheels to incline the bed section upwardly from the first U-shaped member. The boot gripping portion includes a second U-shaped member extending from an end of the bed section opposite to the first U-shaped member. The second U-shaped member has a configuration substantially the same as the first U-shaped member. The second U-shaped member is disposed along a longitudinal center line of the bed section and is secured thereto with the free ends thereof extending beyond the bed section.

12 Claims, 3 Drawing Figures

BOOT REMOVAL APPARATUS

This invention relates to a novel boot apparatus and more particularly relates to a new apparatus for removing boots.

The removal of boots from the feet has presented problems for people throughout history. Boots extend upward from the foot along the lower leg, so they are much more difficult to remove than a conventional shoe. Also, since many boots fit relatively snugly along the leg, the difficulties of removing boots are compounded.

The removal of boots without assistance can involve considerable strength, dexterity and body contortions. A person usually will sit on a chain, cross one leg over the other and tug on the lower part of the boot while wiggling the foot inside the boot to slowly slide the foot free from the boot.

Although young people and those with a high degree of flexibility can usually remove their boots without assistance, older persons and those of more bulky stature find it a very difficult or even impossible task. Even those who can perform the task without excessive effort still consider it to be an unpleasant but necessary task to be completed as quickly as possible.

A boot wearer may ask the help of another person, if available, to hold on to the boot while the wearer slides his foot free. If a boot wearer is not affluent enough to have a servant, he may have one of his children or even his wife assist in the removal.

Bootjacks have been developed to aid a person in removing his boots without assistance from another. Bootjacks ordinarily include an elongated board with a cutout section at one end. A cross piece is located under the board spaced from one end.

In using the bootjack, an individual places the bootjack in front of him and places one foot on the board behind the cross piece. Then, the heel of the boot on the other foot is pressed against the cutout and the foot withdrawn from the boot. The position of the foot then is reversed to remove the other boot in the same way.

Although such bootjacks function satisfactorily in many situations, they are not without their shortcomings. First of all, they are of considerable size and mass. Unless a user has a specific location at which he removes his boots regularly, the device has to be moved to the area in which it is to be used. This ordinarily requires that the device be picked up and carried to the desired location.

Furthermore, since the devices are not especially attractive, most people store them out of sight when they are not being used. Thus, movement of the devices from storage to a convenient spot for use and back to the storage area becomes a regular occurrence with each use. In addition, the shape of the common bootjack is such that it is not convenient to carry. In fact, some people may have to use two hands to carry it. Moreover, the inclination of the board of the device may not be at a convenient angle to the floor so a person may not be able to use it easily without placing his body and/or legs in a contorted position.

From the above discussion, it is clear that hand and bootjack boot removal methods previously employed do not provide a satisfactory solution for some users. Thus, there is a need for a new boot removal apparatus that overcomes the deficiencies and shortcomings of earlier procedures and devices.

The present invention provides a novel boot removal apparatus with features and advantages not found in previous bootjacks. The boot removal apparatus of the invention can be used simply and comfortably by persons of different sizes and ages in a variety of body and leg positions. The apparatus accommodates boots of different sizes and shapes. The apparatus can be moved easily and conveniently.

The boot removal apparatus of the present invention is simple in design and can be produced relatively inexpensively. The apparatus can be fabricated from commercially available materials and components. Conventional industrial techniques and procedures can be employed in its manufacture.

The boot removal apparatus is attractive in appearance and can be used as a decoration so it does not have to be stored out of sight. The apparatus is durable in construction and has a long useful life without maintenance.

These and other benefits and advantages of the novel boot removal apparatus of the present invention will be apparent from the following description and the accompanying drawings in which.

Figure 1:
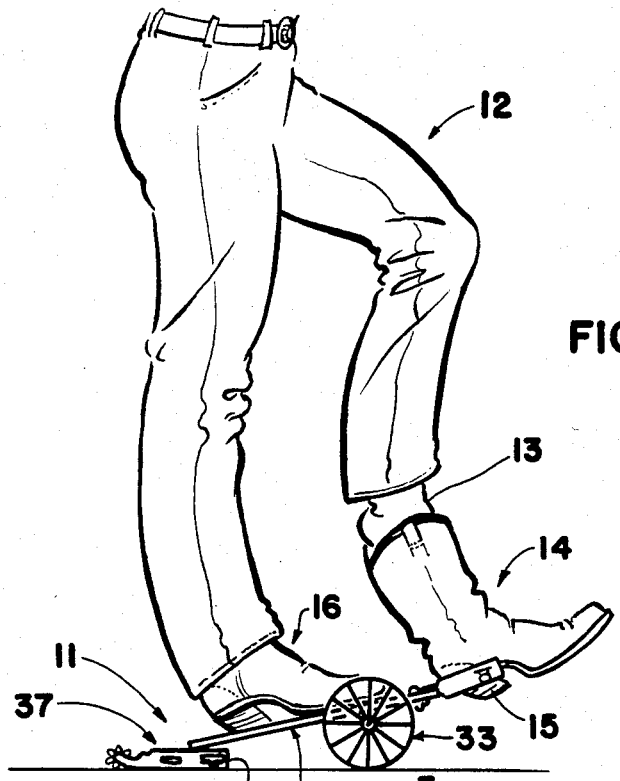
FIG. 1 is a side view of the boot removal apparatus of the invention in use.

As shown in the drawings, one form of the novel boot removal apparatus 11 of the present invention is being used by a person 12. A foot 13 is being withdrawn from a boot 14, the heel 15 of which is being gripped by the apparatus 11. The other foot in boot 16 is applying pressure to the apparatus to hold it in position.

The boot removal apparatus 11 of the present invention includes a platform portion 20, an undercarriage portion 21 and a boot gripping portion 22. The platform portion 20 of the apparatus 11 includes an elongated bed section 23. The bed section has a substantially rectangular configuration with a length significantly longer than the width thereof. Advantageously, the bed section has a length more than twice the width thereof. The bed section preferably includes a plurality of longitudinal members 24.

The undercarriage portion 21 of the boot removal apparatus 11 of the present invention includes a transverse axle section 26 extending under the bed section 23. The free ends 27 and 28 of the axle section 26 extend beyond the side edges 29 and 30 of the bed section. The axle section 26 is located intermediate the ends of the bed section and advantageously forward of a transverse center line.

Wheels 32 and 33 are mounted on the free ends 27 and 28 of the axle section 26. The wheels preferably include radial spoke members 34 and a peripheral rim section 35.

The undercarriage portion 21 also includes a first U-shaped member 37 mounted under the bed section 23. The U-shaped member is mounted adjacent an end 38 of the bed section that advantageously is remote from the axle section 26. The member 37 is mounted so free ends 39 and 40 thereof are in contact with the underside of the bed section 23 so an arcuate section 41 of the member 37 extends beyond the bed section. The bed section preferably overlaps approximately one-half of the first U-shaped member.

Figure 2:
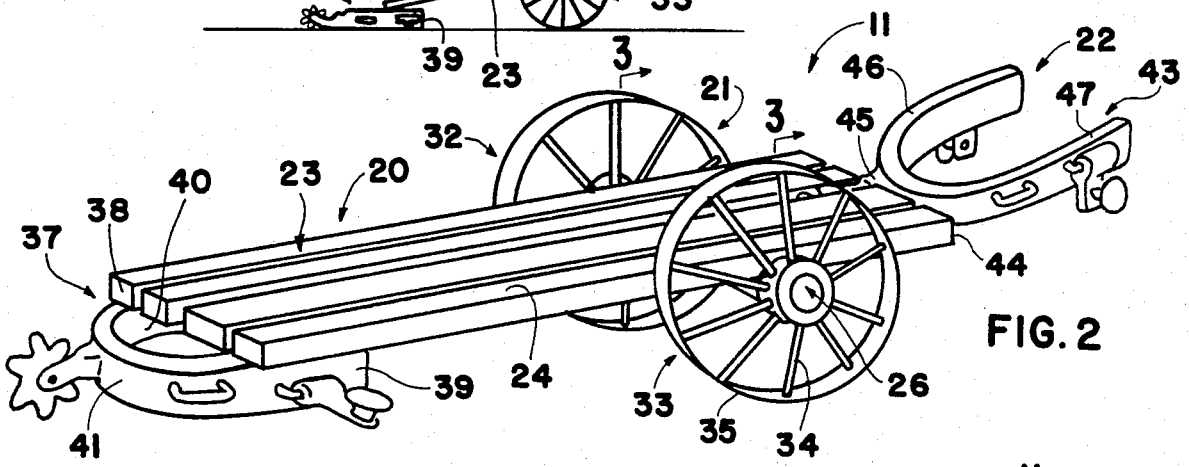
FIG. 2 is an enlarged view in perspective of the boot removal apparatus shown in FIG. 1.

The first U-shaped member 37 has a thickness, that is, a vertical dimension as shown in FIGS. 1 and 2 of the drawings, significantly less than a radius of the wheels 32 and 33. This construction inclines the bed section 23 upwardly from the U-shaped member.

The boot gripping portion 22 of the removal apparatus 11 of the invention includes a second U-shaped member 43. The second U-shaped member 43 extends from an end 44 of the bed section 23 opposite to end 38 under which first U-shaped member 37 is mounted. The second U-shaped member has a configuration substantially the same as the first U-shaped member.

The second U-shaped member 43 includes a tail section 45 that extends in a direction opposite to that of the free ends 46 and 47 thereof. The tail section 45 is disposed along a longitudinal center line of the bed section 23 and is secured thereto. The free ends 46 and 47 extend beyond the end 44 of the bed section.

The free ends 46 and 47 of the second U-shaped member 43 advantageously are inclined upwardly with respect to the bed section 23. The first and second U-shaped members 37 and 43 preferably are bar members. Especially useful as the U-shaped members are spurs that are affixed to the opposite ends of the bed section 23.

Advantageously, the first and second U-shaped members are welded to the bed section. The bed section and the first and second U-shaped members preferably are a unitary structure.

The boot removal apparatus of the present invention may be fabricated from any of a variety of materials and components. Suitable materials include metals, wood, plastic, combinations thereof and the like. Advantageously, the first and second U-shaped members are formed of metal and preferably are spurs. The bed section may be formed of wood or metal as desired.

In the use of the boot removal apparatus 11 of the invention as shown in the drawings, a person 12 who wishes to remove his boots 14 and 16 positions the apparatus in front of his feet. To position the apparatus in the desired location, the user simply pushes the apparatus across the floor with a foot. The apparatus can be moved easily with a foot since the apparatus 11 includes wheels 32 and 33. Similarly, because the apparatus has a pleasant decorative appearance, the apparatus 11 will be on display close at hand rather than in a closet or under a piece of furniture.

Figure 3:
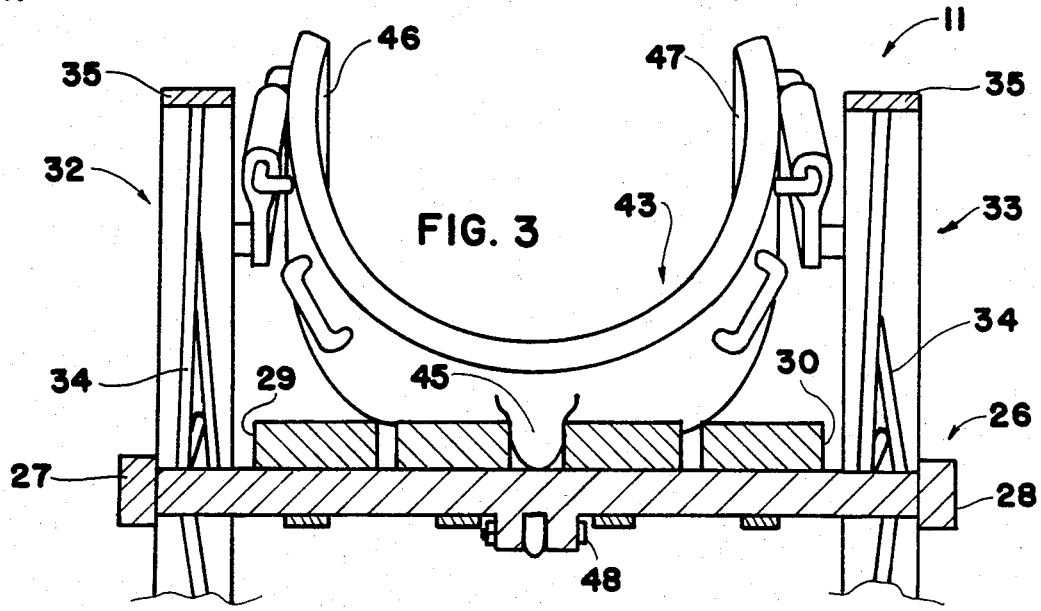
FIG. 3 is a further enlarged sectional view of the boot removal apparatus shown in FIG. 2 taken along line 3—3 thereof.

When the apparatus is in position, the user places one foot on the bed section 23 as indicated with boot 16 in FIG. 1. With the apparatus 11 of the invention, the inclination and position of the front U-shaped member 43 can be changed to accommodate the user's body and leg positions. This can be accomplished easily by sliding the rear foot forward on the bed section. This shifts the center of gravity of the apparatus so the bed section can pivot about the axle section 23 and wheels 32 and 33, if desired. Another way to change the inclination is to provide an adjustable pivotal connection between the member 43 and the bed section, shown as bolt 48 in FIG. 3.

The other boot 14 is inserted between the free ends 46 and 47 of the second U-shaped member 43 extending from the front end 44 of the bed section. Heel 15 of the boot 14 is pressed rearwardly to provide firm contact with the apparatus 11. In this position, the foot 13 is slid upwardly from the boot 14 until it is free.

The procedure is repeated for removal of the second boot 16 except the positions of the feet are reversed. The foot 13 from which the boot 14 has been removed is positioned on the bed section 23. Then, the heel of boot 16 is inserted between the free ends 46 and 47 of the U-shaped member 43 and the heel pressed against the end 44 of the bed section. The second foot is removed from the boot 16 by sliding it upwardly out of the boot.

Both boots 14 and 16 now are removed and the apparatus 11 is ready for storage. Since it has a decorative appearance, the apparatus can be slid with a foot into a display location and the task is completed.

The above description and the accompanying drawings show that the present invention provides a novel boot removal apparatus with features and advantages not found in previous boot removal devices and procedures. The apparatus simplifies boot removal. With the apparatus of the invention, boots can be removed easily and quickly by persons who cannot remove them by themselves with their hands.

The boot removal apparatus of the present invention is simple in design and can be produced relatively inexpensively. The apparatus can be fabricated from commercially available materials and components using conventional manufacturing techniques. The apparatus is durable in construction and has a long useful life without maintenance.

The boot removal apparatus of the invention can be used efficiently and comfortably by persons of all ages and body types. The apparatus can be used with boots of various styles and sizes conveniently.

It will be apparent that various modifications can be made in the boot removal apparatus described in detail above and shown in the drawings within the scope of the invention. The size, configuration and arrangement of components can be different to meet specific requirements. The apparatus can be formed as a single piece or can be an assembly of different components. The boot gripping portion can include U-shaped members 43 of different sizes in adjacent positions, if desired. These and other changes can be made in the boot removal apparatus of the invention provided the functioning and operation thereof are not adversely affected. Therefore, the scope of the present invention is to be limited only by the following claims.

What I claim is:

1. Boot removing apparatus including a platform portion, an undercarriage portion and a boot gripping portion; said platform portion including an elongated bed section, said bed section having a substantially rectangular configuration with a length significantly longer than the width thereof; said undercarriage portion including a transverse axle section extending under said bed section with free ends of said axle section extending beyond said edges of said bed section, wheels mounted on said free ends of said axle section, a first U-shaped member mounted under said bed section adjacent an end thereof, said first U-shaped member being mounted so free ends thereof are in contact with an underside of said bed section and an arcuate section thereof extends beyond said bed section, said free ends of said first member being aligned longitudinally of said bed section, said first U-shaped member having a thickness significantly less than a radius of said wheels to incline said bed section upwardly from said first U-shaped member; said boot gripping portion including a second U-shaped member extending from an end of said bed section opposite to said first U-shaped member, said second U-shaped member having a configuration substantially the same as said first U-shaped member, said second U-shaped member being disposed along a longitudinal center line of said bed section and secured thereto with said free ends extending beyond said bed section; whereby a user can place one foot on said bed section and insert a heel of a boot with a second foot therein into said second U-shaped member and withdraw said second foot from said boot.

2. Boot removing apparatus according to claim 1 wherein said bed section includes a plurality of longitudinal members.

3. Boot removing apparatus according to claim 1 wherein said bed section and said U-shaped members are a unitary structure.

4. Boot removing apparatus according to claim 1 wherein said length of said bed section is more than twice the width thereof.

5. Boot removing apparatus according to claim 1 wherein said wheels include radial spoke members and a peripheral rim section.

6. Boot removing apparatus according to claim 1 wherein said bed section overlaps approximately one-half of said first U-shaped member.

7. Boot removing apparatus according to claim 1 wherein said first U-shaped member is mounted under said bed section adjacent an end thereof remote from said axle section.

8. Boot removing apparatus according to claim 1 wherein said free ends of said second U-shaped member are inclined upwardly with respect to said bed section.

9. Boot removing apparatus according to claim 1 wherein said U-shaped members are bar members.

10. Boot removing apparatus according to claim 1 wherein said U-shaped members are welded to said bed section.

11. Boot removing apparatus according to claim 1 wherein said second U-shaped member includes a tail section extending in a direction opposite to that of free ends thereof, said tail section being secured to said bed section.

12. Boot removing apparatus according to claim 1 wherein said U-shaped members are spurs affixed to said bed section.

* * * * *